US006105814A

United States Patent [19]

Chen

[11] Patent Number: 6,105,814

[45] Date of Patent: Aug. 22, 2000

[54] COLORED REFLACTING CUP

[76] Inventor: Li-Hsiu Shih Chen, P.O. Box 90, Tainan City, Taiwan

[21] Appl. No.: 09/495,352

[22] Filed: Feb. 1, 2000

[51] Int. Cl.[7] ..... B65D 39/04

[52] U.S. Cl. ..... 220/625; 206/217; 206/457; 220/592.17; 220/62.12; 215/6; 215/370; 215/378

[58] Field of Search ..... 215/2, 378, 370, 215/6; 220/602, 592.17, 62.12, 603, 625; 206/217, 457

[56] References Cited

U.S. PATENT DOCUMENTS

| | | | |
|---|---|---|---|
| 279,216 | 6/1883 | Berlien | 215/6 |
| 581,814 | 5/1897 | Durkin et al. | 215/378 |
| 758,869 | 5/1904 | Stover | 215/2 |
| 1,289,218 | 12/1918 | Maiden | 215/6 |
| 1,647,175 | 11/1927 | Grunberg | 215/370 |
| 1,694,754 | 12/1928 | Porter | 215/378 |
| 2,187,558 | 1/1940 | Kushima | 215/6 |
| 2,779,472 | 1/1957 | Febbraro | 215/2 |
| 3,272,366 | 9/1966 | Ikeda | 215/378 |
| 4,771,902 | 9/1988 | Teng | 215/2 |
| 5,853,829 | 12/1998 | Krishnakumar et al. | 215/370 |

*Primary Examiner*—Joseph M. Moy

[57] ABSTRACT

A colored refracting cup includes a cup body, a recess chamber formed in a bottom of the cup body, the recess chamber having multi-angle cut faces, and a bottom cap fused with the bottom of the cup body by means of supersonic welding process. An adornment with multi-angle cut faces for refraction is fixed on the bottom cap and plated with many colors. The colors of the adornment may be refracted through the multi-angle cut faces of the recess chamber to appear on the cup body, permitting the cup body look like very brilliant and glamorous and enhancing worth of the cup.

4 Claims, 4 Drawing Sheets

COLORED REFLACTING CUP

BACKGROUND OF THE INVENTION

This invention relates to a colored refracting cup, particularly to one having a recess chamber formed in a bottom, and inner walls of the recess chamber and an adornment inside the recess chamber have multi-angle cut faces. The adornment is further plated with many colors, which may be refracted by the multi-angle cut faces to the body of a cup so that the cup has multi-colored refraction from the lower part to the upper part.

Common conventional cups are generally single colored, comparatively monotonous with few alterations. In order to attract consumers curiosity and purchasing desire, some makers make cups printed or adhered with pictures or patterns, but printed or adhered pictures or patterns can only appear flat feeling without 3D appearance. In addition, printed or adhered pictures or patterns may fade away or peel off owing to moisture to lose their effect.

SUMMARY OF THE INVENTION

The objective of the invention is to offer a cup having multi-colored refraction effect.

The main feature of the invention is a recess chamber formed in a bottom of a cup, and many cut faces of different angles are formed in inner walls of the inner chamber, and a bottom cap with an adornment on the upper surface is fused with the bottom of the cup. The adornment has many cut faces of different angles and plated with many colors.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
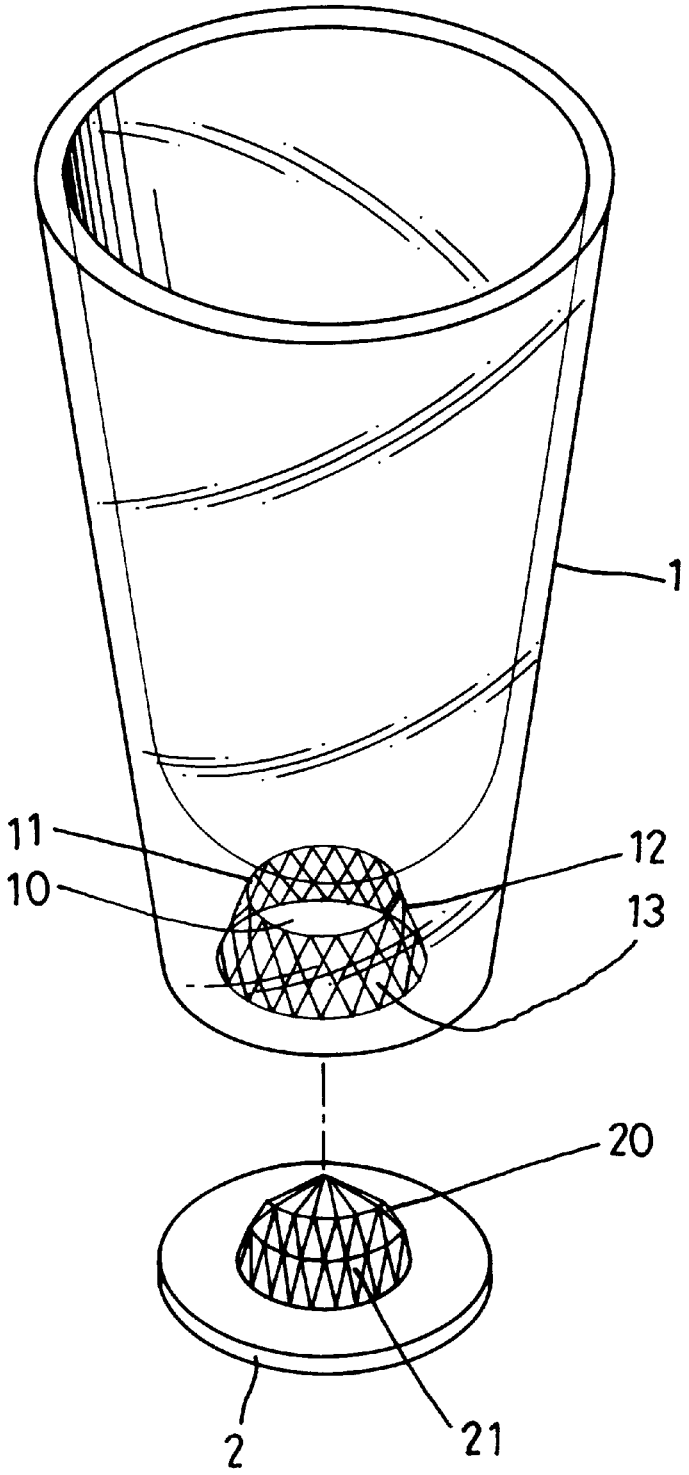
FIG. 1 is an exploded perspective view of a colored refracting cup in the present invention.
Figure 2:
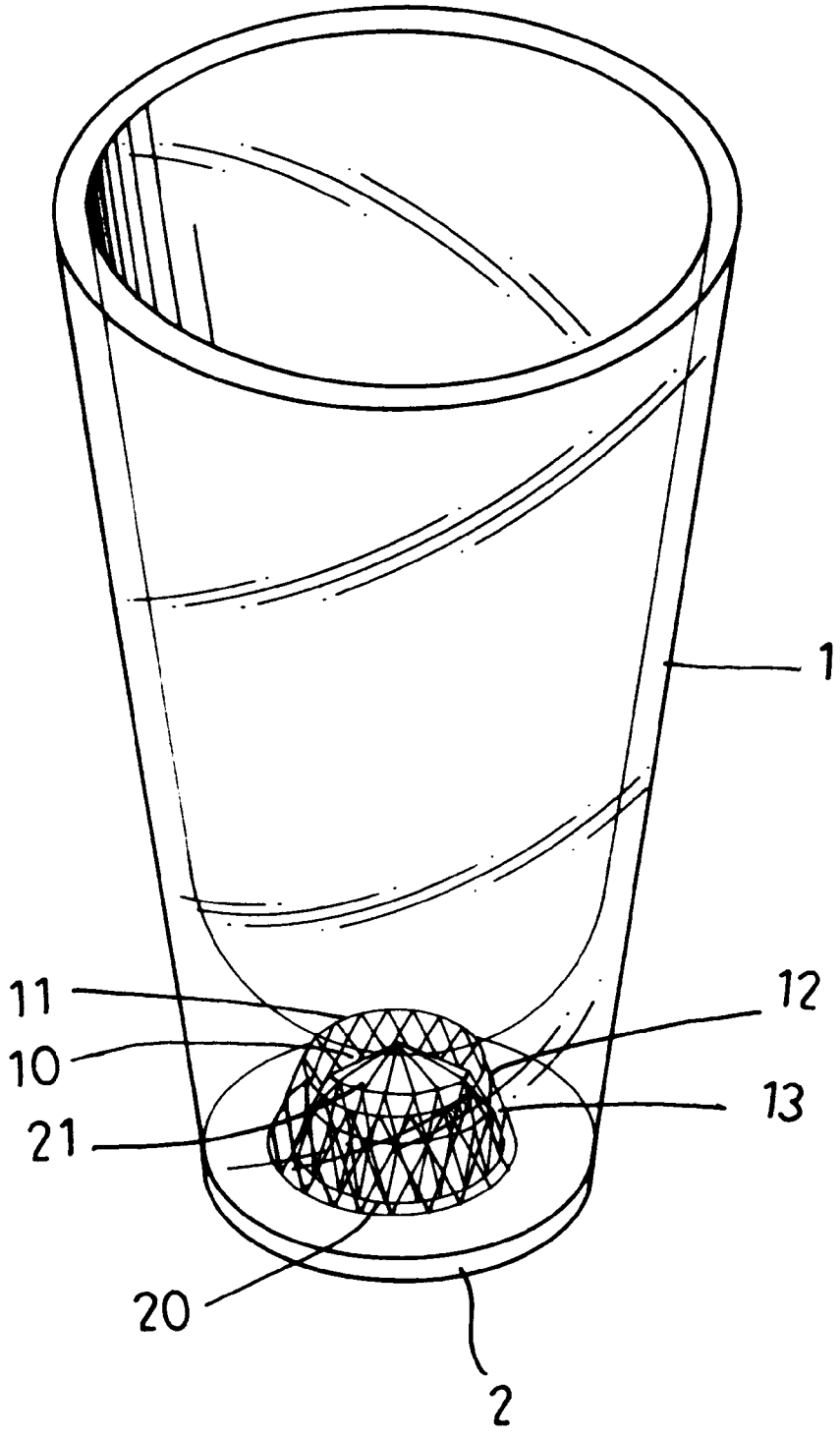
FIG. 2 is a perspective view of the colored refracting cup in the present invention.

A preferred embodiment of a colored refracting cup in the present invention, as shown in FIGS. 1 and 2, includes a transparent cup body 1, a recess chamber 10 formed in a bottom, a flat center surface 11 and a cone-shaped annular surface 12 formed in the recess chamber 10, and multi-angle cut faces 13 formed on the cone-shaped annular surface 12. A bottom cap 2 is fused with the bottom of the cup 1 by means of supersonic welding process, a semi-spherical adornment 20 fixed on the bottom cap 2, the semi-spherical adornment 20 having multi-angle cut faces 21 and plated with many colors.

Figure 3:
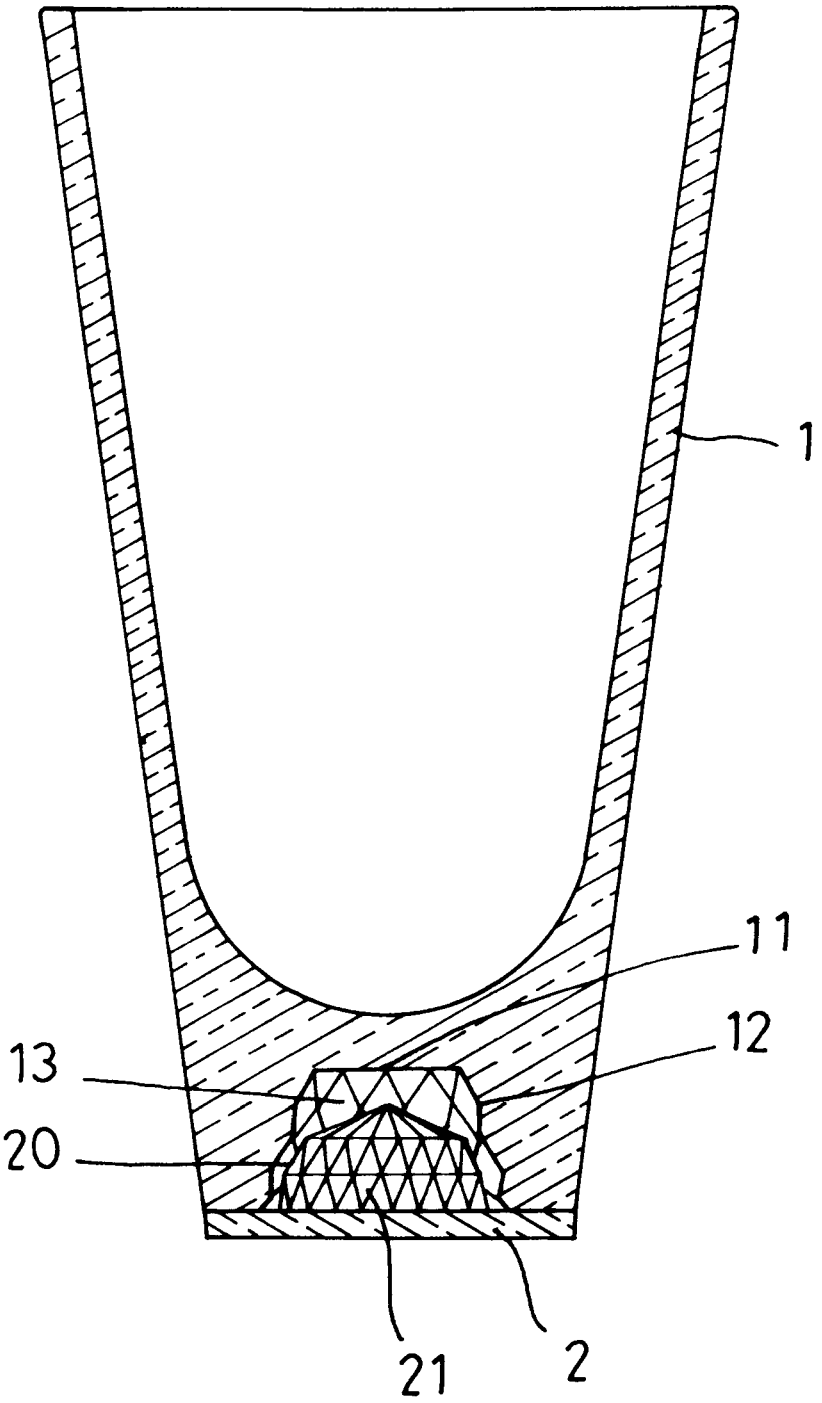
FIG. 3 is a cross-sectional view of the colored refracting up in the present invention; and, FIG. 4 is a perspective view of another embodiment of a colored refracting cup in the present invention.

In assembling, as shown in FIGS. 1, 2 and 3, the bottom cap 2 is fused with the bottom of the cup body 1 by means of supersonic welding process, with the adornment 20 positioned in the recess chamber 10, finishing assemblage of the colored refracting cup in the invention.

As the cup body 1 is transparent and the recess chamber 10 has the cone-shaped annular wall 12 with multi-angle cut faces 13 for refraction and the adornment 20 in the recess chamber 10 having many plated colors, the many colors of the adornment 20 are reflected through the refracting cut faces 13, letting the colors of the refracting cut faces 21 refracted on the cup body 1. So lookers may see many colors through the cup body 1, with the multi-colors of the adornment 20 appearing on the center flat surface of the recess chamber 10 if seen from the mouth of the cup body 1. Then the cup body 1 may have many colors crossing each other by means of the multi-angle cut faces.

Figure 4:
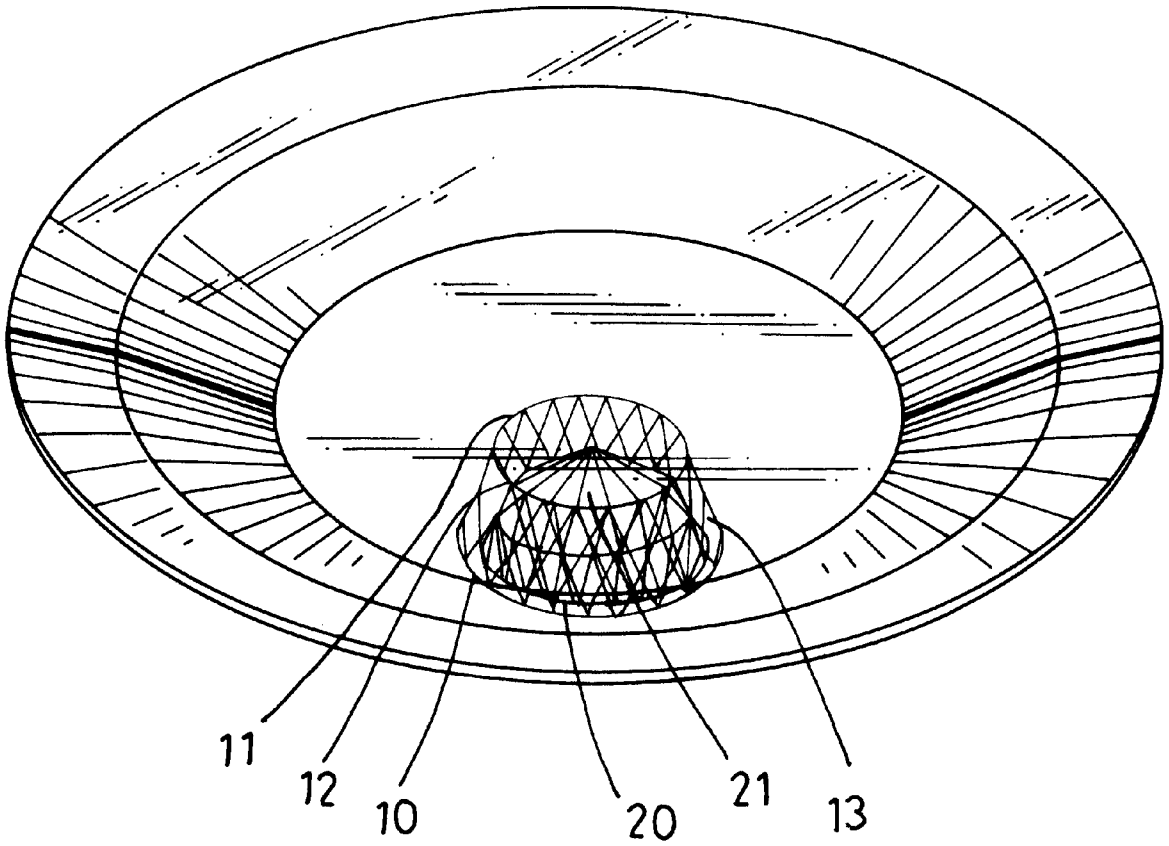

This structure in the invention can be applied to jars, cans, bottles, dishes or plates, as shown in FIG. 4 with provision of refracting cut faces 13, 21 for refracting colors to have the same effect as the cup body 1.

The colored refracting cup in the invention has the following advantages, as can be understood from the aforesaid description.

1. The multi-angle cut faces in the bottom of a cup body can permit the cup body look like many colors crossing one another, very brilliantly.

2. The cut faces are of different angles, permitting the cup body look like multi-colored refraction.

3. Glamorous visual effect of the cup body can enhance worth of products.

While the preferred embodiment of the invention has been described above, it will be recognized and understood that various modifications may be made therein and the appended claims are intended to cover all such modifications which may fall within the spirit and scope of the invention.

What is claimed is:

1. A colored refracting cup comprising a recess chamber formed in a bottom of a cup body, said recess chamber having multi-angle cut faces for refraction, a bottom cap fused with the bottom of said cup body and having an adornment fixed on said bottom cap, said adornment having multi-angle cut faces on its outer surface and plated with many colors, said colors on said adornment refracted through said multi-angle cut faces of said recess chamber to appear on said cut body, said cut boy having multi-colored effect crossing one another.

2. The colored refracting cup as claimed in claim 1, wherein the structure of said cup body is applied to jars, cans, bottles, dishes, plates, permitting them to have the same colored refracting effect.

3. The colored refracting cup as claimed in claim 1, wherein said cut body is transparent.

4. The colored refracting cup as claimed in claim 1, wherein said recess chamber formed in the bottom of said cup body has a flat surface in the center portion.

* * * * *